US006655934B2

(12) United States Patent
Mittelstein et al.

(10) Patent No.: US 6,655,934 B2
(45) Date of Patent: Dec. 2, 2003

(54) INVERTED PERISTALTIC PUMPS AND RELATED METHODS

(75) Inventors: Michael Mittelstein, Laguna Niguel, CA (US); John T. Sorensen, Ladera Ranch, CA (US); Soheila Mirhashemi, Laguna Niguel, CA (US)

(73) Assignee: Innovent, L.L.C., San Juan Capistrano, CA (US)

( * ) Notice: Subject to any disclaimer, the term of this patent is extended or adjusted under 35 U.S.C. 154(b) by 30 days.

(21) Appl. No.: 10/102,608

(22) Filed: Mar. 20, 2002

(65) Prior Publication Data

US 2002/0146338 A1 Oct. 10, 2002

Related U.S. Application Data

(60) Provisional application No. 60/277,562, filed on Mar. 21, 2001.

(51) Int. Cl.[7] ..... F04B 43/08; F04B 43/12; F04B 17/00

(52) U.S. Cl. ..... 417/477.9; 417/474; 417/477.1; 417/477.3; 417/477.9; 417/360

(58) Field of Search ..... 417/477.9, 474, 417/477.1, 477.3, 360

(56) References Cited

U.S. PATENT DOCUMENTS

| | | | | |
|---|---|---|---|---|
| 3,582,234 A | * | 6/1971 | Isreeli et al. | 417/477.3 |
| 3,585,650 A | * | 6/1971 | Lekberg et al. | 417/477.13 |
| 5,230,614 A | | 7/1993 | Zanger et al. | 417/477.9 |
| 5,429,486 A | | 7/1995 | Schock et al. | 417/476 |
| 5,470,211 A | | 11/1995 | Knott et al. | 417/477.9 |
| 5,630,711 A | | 5/1997 | Luedtke et al. | 417/477.9 |
| 5,688,112 A | | 11/1997 | Garay | 417/477.1 |
| 5,857,843 A | * | 1/1999 | Leason et al. | 417/477.9 |
| 6,062,829 A | * | 5/2000 | Ognier | 417/477.9 |
| 6,099,272 A | | 8/2000 | Armstrong et al. | 417/476 |
| 6,102,678 A | | 8/2000 | Peclat | 417/477.7 |
| RE37,704 E | * | 5/2002 | Eshel | 604/113 |

* cited by examiner

*Primary Examiner*—Charles G. Freay
*Assistant Examiner*—Michael K. Gray
(74) *Attorney, Agent, or Firm*—Robert D. Buyan; Stout, Uxa, Buyan & Mullins, LLP

(57) ABSTRACT

Inverted peristaltic pumps and related apparatus/methods wherein one or more compressible pump tubes are formed or mounted on a core member and one or more tube compressing members move about the core member so as to compress the tube(s) and propel a fluid through the tube(s). The core member may be removable and the pump tube(s) may be pre-mounted on the core member to form a disposable or reusable tubing cartridge. The core member or tubing cartridge may be easily inserted into and removed from the pump. In some embodiments troughs or grooves may be formed on the core member and the tube(s) may be disposed in such troughs or grooves.

17 Claims, 7 Drawing Sheets

INVERTED PERISTALTIC PUMPS AND RELATED METHODS

RELATED APPLICATIONS

This application claims priority to U.S. Provisional Patent Application Ser. No. 60/277,562 entitled Inverted Preistaltic Pumps and Related Methods filed on Mar. 21, 2001, the entire disclosure of such provisional application being expressly incorporated herein by reference.

FIELD OF THE INVENTION

The present invention relates to pumping devices, related equipment and methods and more particularly to inverted peristaltic pumps, tubing kits for use with such pumps and related methods for using such pumps.

BACKGROUND OF THE INVENTION

Numerous types of peristaltic pumps have been known in the prior art. In general, peristaltic pumps are devices that transfer fluid through one or more elongate, at least partially flexible, tube(s) by compressing each tube in a peristaltic manner. Such peristaltic compression of the tube serves to push or pull fluid through the lumen of each tube. The fluid transport is effectuated by moving the region of compression along the length of the tube. Such movement of the region of compression is typically achieved by way of one or more rollers driven by a mechanical drive mechanism that guides each roller along a re-circulating path. The path of each roller is typically configured such that each roller will pinch-off the inner lumen of the tube it moves along a portion of the length of the tube. Most commonly the roller rotates in a circular path about a central axis of rotation.

In order for a peristaltic pump to function as a positive displacement pump, it must effect at least first and second regions of compression on each tube and the second region of compression must be created before the fist region of compression is released. The length of the tube between the first and second regions of compression define a period.

Typically, the each peristaltic pump tube is mounted within the in a U-shaped or arc-shaped configuration whereby some portion of each tube overlaps a potion of a path traveled by a roller. In some peristaltic pumps, the desired compression or pinching-off of each tube is achieved by compressing the pump tube(s) between the roller(s) and an adjacent stationary member (a backing plate). In other peristaltic pumps, the desired compression or pinching-off of the tube(s) is achieved by stretching the tubes over the roller(s), without involvement of any stationarily member or backing plate, however such designs can be somewhat disadvantageous due to the propensity for most plastic tubes to stretch or creep thereby resulting in loosening of the tube(s) over time.

One advantageous feature of virtually all peristaltic pumps is that the fluid does not contact the pump's mechanical drive mechanism since the fluid is always confined within and moved through the flexible tube(s). Therefore, by using the peristaltic pumps for a medical application, the cost of the disposable or re-sterilizable portion of the medical instrument may be reduced.

One drawback associated with at least some peristaltic pumps is that the fluid outflow from a peristaltic pump tends pulsate. The prior art has included devices and methods that purport to reduce such pulsation, such as the reduced pulsation pump head described in U.S. Pat. No. 5,230,614 which has multiple rollers that compress the tube at relatively close intervals, thereby minimizing the pulsatile nature of the pump outflow. This method of fluid transfer may be costly and the wear and tear on the tubing can be high. Since each roller is collapsing a small portion of the tube at any given time, the likelihood of the tube to creep or become displaced is high.

Other prior art patents describe other modification to the traditional peristaltic pump designs including the use of a helical tubing arrangement as described in Canadian Patent No. 320,994, a multiple tube and cylindrical format as described in U.S. Pat. No. 5,688,112, a looped tube path as described in U.S. Pat. No. 5,630,711 and a single roller loop tube as described in U.S. Pat. No. 5,429,486.

The loading of the pump tubing on common peristaltic pumps is often cumbersome due to the fact that the flexible tubes are typically unsupported until loaded, and this my not be easy to maneuver into place.

The present invention overcomes at least some of the shortcomings of the prior art peristaltic pumps by providing peristaltic pumps that provide relatively non-pulsatile flow with tubing that is easily loadable and may be pre-mounted on a central core member.

SUMMARY OF THE INVENTION

The present invention provides new peristaltic pump devices in which the tube(s) is/are mounted on an arched or round central core member and one or more compression members (e.g., rollers, feet, a cylinder, etc.)) rotate, circulate, traverse or otherwise move about the central core member so as to cause the desired regions of compression in the pump tube(s). This arrangement results in comparatively smooth, non-pulsatile fluid transfer. Also, this arrangement allows for perpendicular rather than tangential compression of the tube(s), thereby minimizing the potential for creeping of the tube(s). In the peristaltic pumps of the present invention, the central core member may be stationary and the compression member(s) (e.g., rollers, feet, a cylinder, etc.) may rotate about the stationary core member. In pumps of the present invention, the tub(s) may be formed or mounted on a reusable or disposable core member to form a unitary tubing/core member assembly that is insertable as a unit or cartridge into the pump, thereby eliminating leakage as tubing is replaced and resultant potential for contamination of the pump components and/or the user's body. Also, in pumps of the present invention, the central core member (e.g, central backing plate) may provides an effective means to maintain or change the temperature of fluid being pumped through the pump tube(s) and, thus, may incorporate or include a heating or cooling element.

In accordance with the present invention, there are provided peristaltic pumps that are of an inverted design (i.e., wherein the fluid conduit (e.g., tubing) is mounted on a central core and a compression member revolves at least part way around the central core to compress the fluid conduit, thereby propelling fluid through the fluid conduit and methods of pumping fluids using such pumps. The inverted peristaltic pumps of the present invention provide economical and controlled fluid delivery with low pulsation and have applicability in many medical and non-medical applications.

Further in accordance with the present invention, the compressible fluid conduit (e.g., tubing) may be mounted or formed on the central core such that it is in abutting contact with the outer surface of the central core, thereby maintaining the desired size and shape of the fluid conduit with minimal stretching or deformation of the fluid conduit during use. Also, changing of the fluid conduit or tubing is simplified by the present invention because the central core having the compressible fluid conduit (e.g., tubing) pre-mounted or pre-formed thereon may be simply inserted into the pump in a position whereby the compression member will rotate at least partially around the core, thereby causing peristaltic compression of the fluid conduit (e.g., tubing) against the central core. Also, the central core may be provided with heating or cooling elements so as to heat or cool fluid as it passes through the fluid conduit(s) mounted or formed on the central core.

Still further in accordance with the present invention, in at least some embodiments, one or more grooves may be formed in the outer surface of the central core and the fluid conduit (e.g., tubing) may be mounted or formed within such groove(s). In some embodiments, a single helical groove may be formed in the outer surface of the core and the fluid conduit (e.g., tubing) may be mounted or formed within such helical groove. In many embodiments, it will be desirable for the fluid conduit (e.g., tubing) to make at least one full rotation around the central core. As described more fully herebelow, in some embodiments wherein the fluid conduit (e.g., tubing) is mounted or formed within groove(s), the depth of such groove(s) may vary to facilitate gradual increasing and decreasing of the amount of compression being applied to the fluid conduit as the compression member moves about the central core. In this regard, the ends of the groove(s) may be deeper than the center of the groove(s) so as to provide for gradual compression of the fluid conduit (e.g., tubing) from one end of the groove where the lumen of the fluid conduit is fully open to a point of complete compression (i.e., where the lumen of the fluid conduit is completely pinched off) followed by gradual decompression to the other end of the groove where the lumen of the fluid conduit is once again fully open.

These general aspects of the invention, as well as numerous other aspects and advantages of the invention, will become apparent to persons of skill in the art who read and understand the following detailed description and the accompanying drawings.

DETAILED DESCRIPTION OF EMBODIMENTS OF THE INVENTION

I. Inverted Peristaltic Roller Pump

Figure 1:
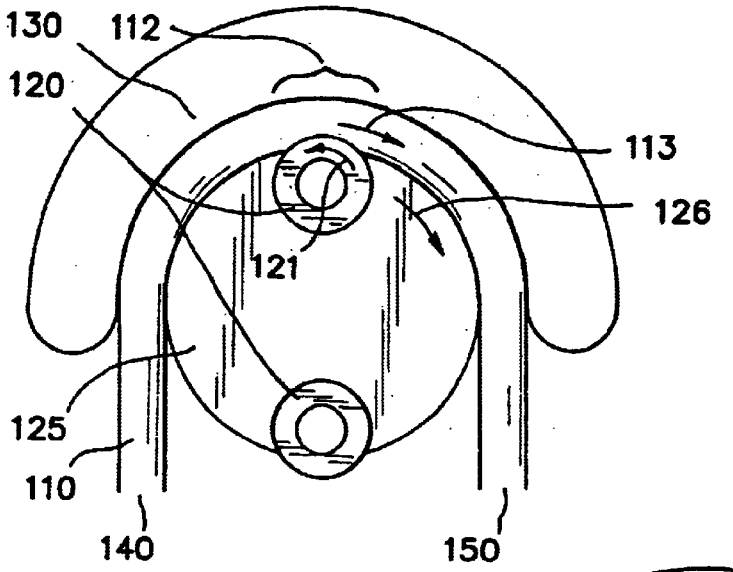
FIG. 1 PRIOR ART
FIG. 1 is a schematic showing of a prior art peristaltic pump.

The following detailed description refers to the accompanying drawings (FIGS. 1–12) which show certain embodiments of the present invention.

Peristaltic roller pumps are commonly used for fluid transfer. Conventional curvilinear configurations (FIG. 1) incorporate an array of two or more rollers 120 mounted on a rotating roller carrier 125 providing for an ex-centric mount for the axis of rotation of the rollers carried thereon and therefore a circular path for said rollers. A flexible tube 110 is placed between a stationary outer shell 130 (the backing plate) and the roller assembly such that the inner lumen of flexible tube 110 is pinched-off between the roller 120 and the outer shell 130 over an occlusion region 112. Rotation of the roller carrier 125 indirection 126 causes the occlusion region 112 to move along the axis of flexible tube 110 in direction 113, and for rollers 120 to rotate in direction 121 due to friction in contact with the concave side of the tube. Fluid is thus pumped from tube inlet 140 to tube outlet 150.

It is often desirable, for example in medical products, to be able to easily change the pump tubing. Loading of the tubing into conventional peristaltic pumps as described in FIG. 1 can be difficult. During the pumping action, the tubing tends to be pulled along its axis, and thus the inlet portion of the tubing must be secured so the tubing will not migrate. Linear peristaltic pumps were developed that address many of these issues. In a linear peristaltic pump, a flexible tube is pressed against a flat stationary shell along a linear axis by one or more moving rollers or cam-sequenced squeezing elements. For such a linear configuration, the flexible tube can be pre-stretched and mounted into a cartridge for easy installation and removal.

Figure 2:
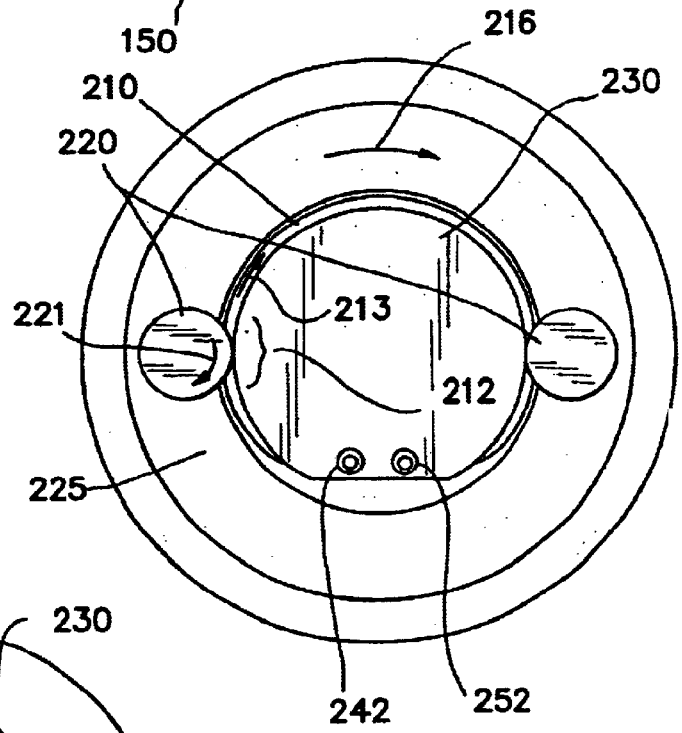
FIG. 2 is a schematic showing of one embodiment of an inverted peristaltic pump of the present invention wherein the compression member(s) comprise two (2) rollers.
Figure 3:
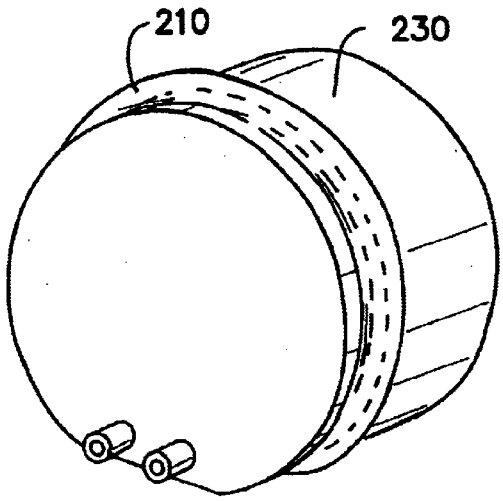
FIG. 3 is a perspective view of the central core/tubing cartridge portion of the pump of FIG. 2.
Figure 4:
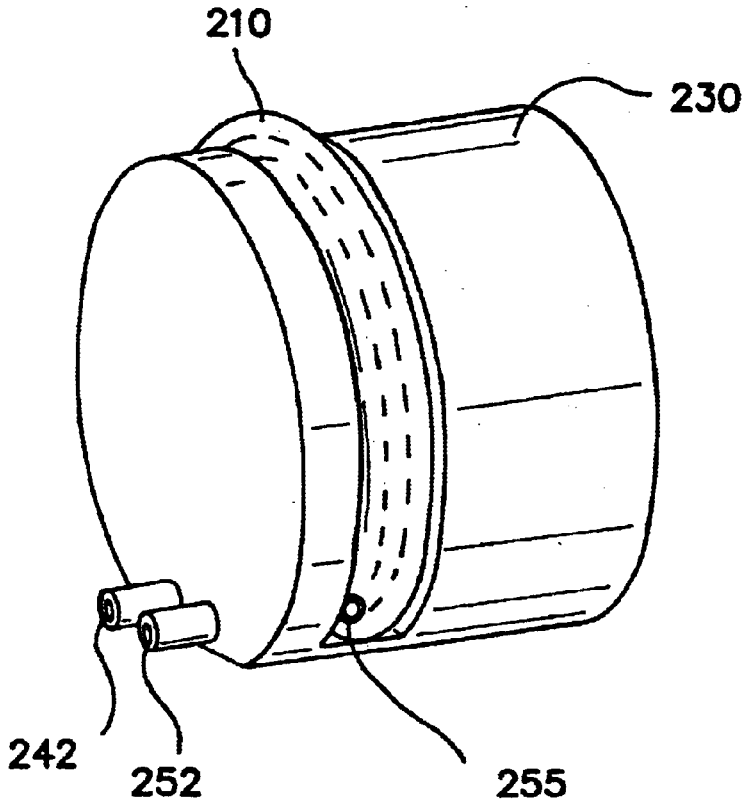
FIG. 4 is a partially rotated view of the central core/tubing cartridge of FIG. 3.

A first invention is a novel curvilinear peristaltic roller pump described in FIG. 2 configured by inverting the roller and backing plate. In this configuration, an array of two or more rollers 220 are mounted on a rotating support 225. A flexible tube 210 is placed into a stationary pump cartridge 230. In this novel configuration, the rollers 220 move over the convex surface of the flexible tube 210. The flexible tube 210 is squeezed between the rollers 220 and the pump cartridge 230 to form an occlusion region 212. In this configuration, rotation of the rotating support 225 in direction 226 causes the rollers 220 to rotate in direction 221 due to friction in contact with the convex side of the tube and for the occlusion region 212 to move along the axis of the flexible tube 210 in direction 213. Fluid is pumped from the inlet port 242 to the outlet port 252 of the pump cartridge 230. The pump cartridge is further described in FIGS. 3–4. In FIG. 3, flexible tube 210 is translucent, allowing visualization of tubing connector 255. In pump cartridge 230, the flexible tube 210 terminates into outlet connector255, which communicates through the body of pump cartridge 230 to outlet port 252. A similar connector 245 arrangement terminates the opposite end of flexible tube 210 and communicates through the pump cartridge 230 to inlet port 242. In FIG. 4, the flexible tube 210 is removed from the pump cartridge 230, allowing for visualization of the channel 232 provided in pump cartridge 230 for the flexible tube 210. This channel 232 keeps flexible tube 210 from migrating along the axis of pump cartridge 230. In addition, the flexible tube 210 can be secured at either end or both ends to ports 245 and 255 to prevent migration of the flexible tube 210 along its axis. This novel configuration offers the advantage that an insertable pump cartridge 230 can be provided carrying the flexible tube 210 and is easily insertable into the pump assembly. One possible additional variation would comprise of a cartridge lacking ports and connectors and having an extended channel such that an independent tube carrying ports could be snapped and strung into it for subsequent insertion into the pump assembly.

Figure 5:
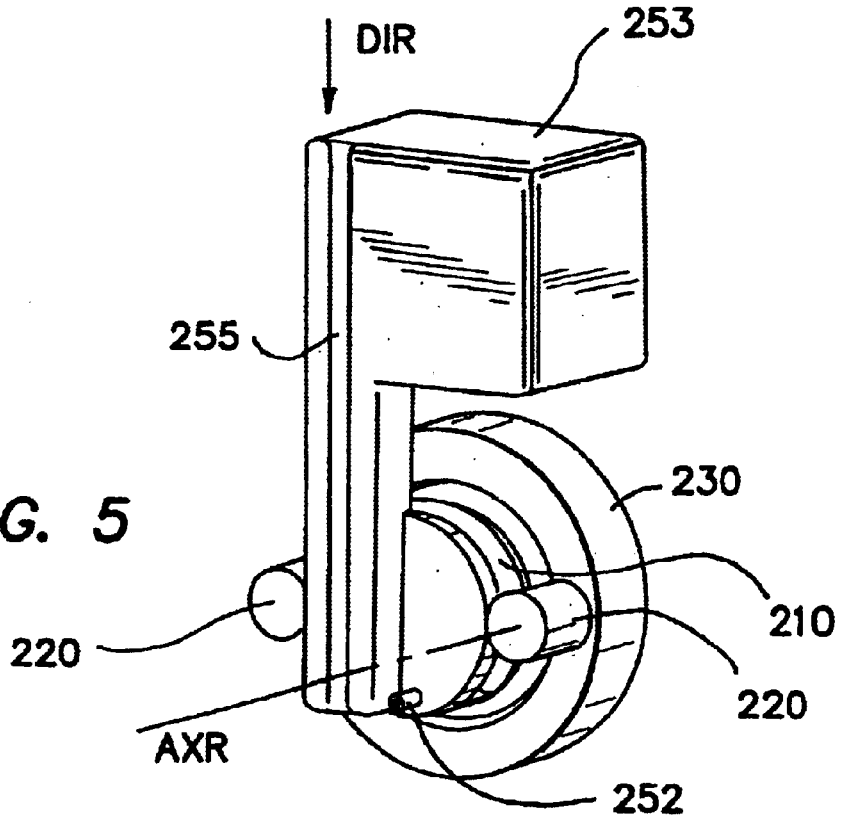
FIG. 5 is a schematic showing of another embodiment of an inverted peristaltic pump of the present invention having a transversely loadable central core/tubing cartridge and an accompanying aspirant collection reservoir.

FIG. 5 shows the pump of FIG. 2 with an optional aspirant reservoir 253 attached to the aspirant outlet port 242. In this embodiment, the core member or tubing cartridge 230 having the pump tubing 210 mounted thereon may be transversely loaded into a position between the rollers 220 such that the rollers 220 may rotate about and compress the helically disposed pump tubing 210. In this regard, it will be appreciated that the core member 230 having the tubing 210 mounted thereon and the aspirant reservoir 253 attached to its outlet port 242 may be lowered vertically into position between the compression members (which in this embodiment are rollers) 220, as shown in FIG. 5. A vertical guide rail or track 255 or other guide surface or apparatus (e.g., a magnet) may be formed on the aspirant reservoir 253 and may interact with a corresponding rail, track, other guide surface or apparatus to guide the core or tubing cartridge 230 into position between the rollers 220. Stated another way, the compression members, namely the rollers 220 rotate about axes of rotation AXR and the core member or tubing cartridge 230 is insertable into an operative position relative to the compression member advancing the core member in a direction DIR that is substantially perpendicular to the axis of rotation AXR.

II. Inverted Helical Roller Pump

Figure 6:
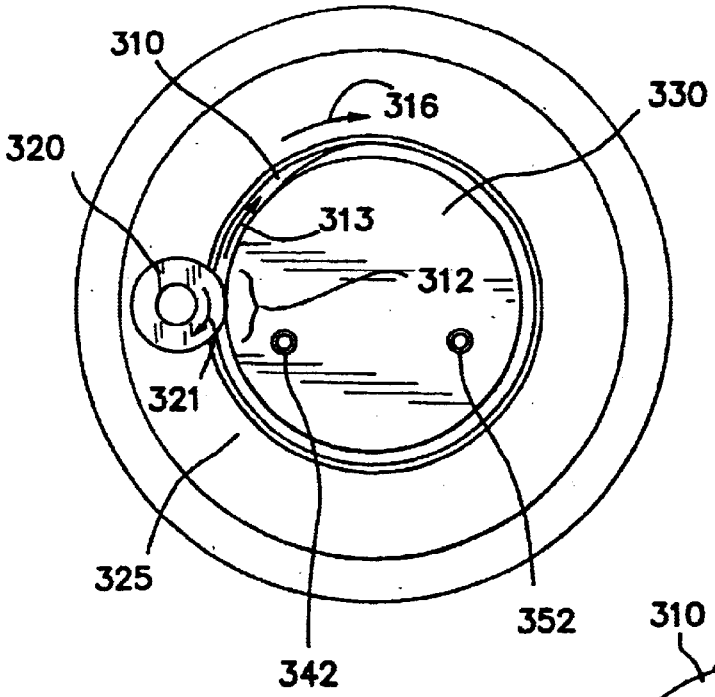
FIG. 6 is a schematic showing of another embodiment of an inverted peristaltic pump of the present invention wherein the compression member(s) comprise a single roller.
Figure 7:
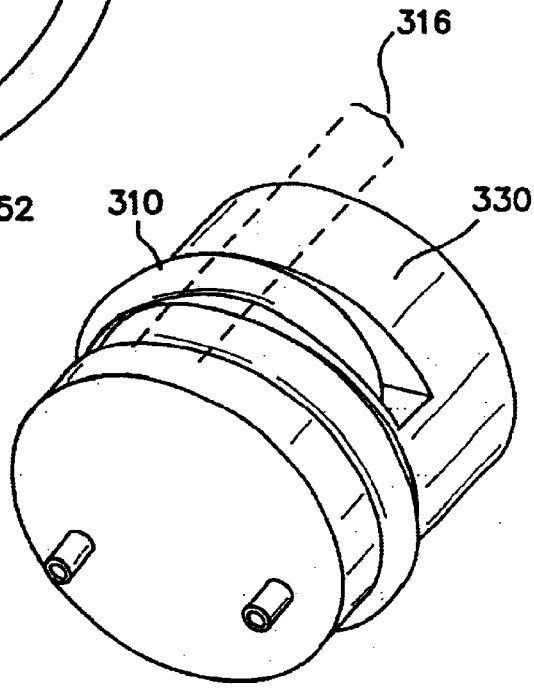
FIG. 7 is a perspective view of the central core/tubing cartridge component of the pump of FIG. 6.
Figure 8:
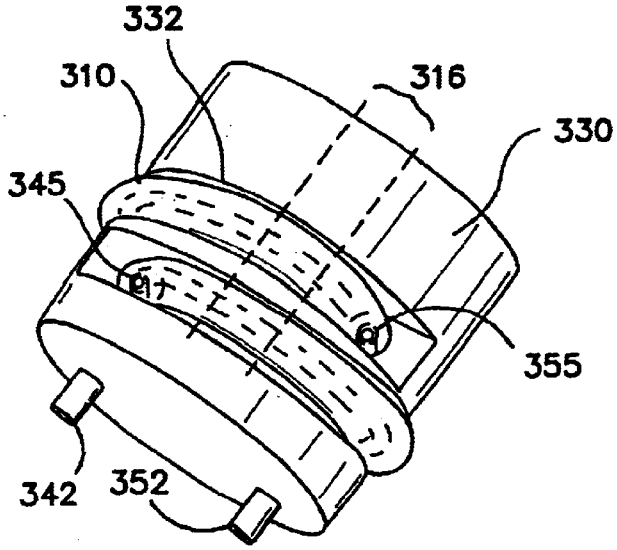
FIG. 8 is a partially rotated and canted view of the central core/tubing cartridge component shown in FIG. 7.
Figure 9:
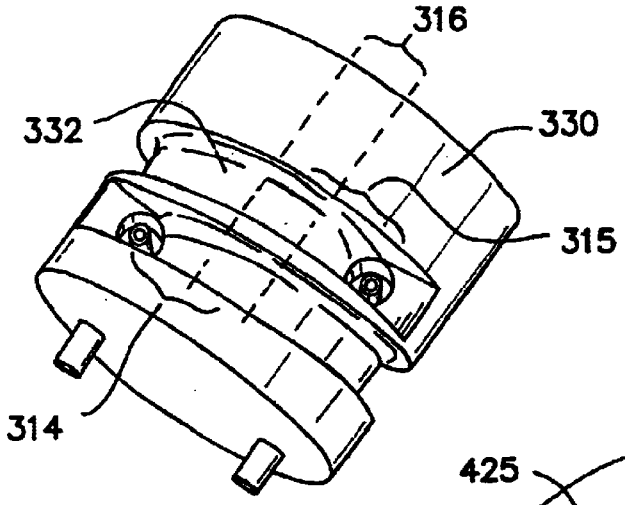
FIG. 9 is a showing of the central core/tubing cartridge component shown in FIG. 7, with the tubing removed.

A second invention is a novel single roller pump described in FIG. 6 that utilizes a helical tubing path as illustrated in FIGS. 7 through 9. If an ex-centric roller carrier is utilized then the pinch before release requirement translates into more than 360 degrees of tubing, which, in turn, requires a longitudinal or other displacement. One way, in which it can be implemented, is a helical path for the tube.

In this configuration, one roller 320 is mounted on a rotating support 325. A flexible tube 310 is placed onto an inserted and than stationary pump cartridge 330. In this novel configuration, the roller 320 moves over the convex surface of the flexible tube 310. The flexible tube 310 is squeezed between the roller 320 and the pump cartridge 330 to form an occlusion region 312. In this configuration, rotation of the rotating support 325 in direction 326 causes the roller 320 to rotate in direction 321 and for the occlusion region 312 to move along the axis of the flexible tube 310 in direction 313. Fluid is pumped from the inlet port 342 to the outlet port 352 of the pump cartridge 330. As appreciated from FIG. 7 a single roller 320 may be utilized because the flexible tube 310 can be simultaneously occluded at its inlet and outlet ends when roller 320 (not shown) passes through region 316. The pump cartridge is further described in FIGS. 8 and 9. In FIG. 8 it is apparent that the flexible tube 310 follows a helical path on pump cartridge 332. Region 316 where roller 320 (not shown) can simultaneously pinch two regions of the flexible tube 310 is also depicted. In FIG. 8, flexible tube 310 is translucent, allowing visualization of tubing connector 345 and 355. In pump cartridge 330, the flexible tube 310 terminates into inlet connector 345, which communicates through the body of pump cartridge 330 to inlet port 342. A similar outlet connector 355 arrangement terminates the opposite end of flexible tube 310 and communicates through the pump cartridge 330 to outlet port 352. In FIG. 9, the flexible tube 310 is removed from the pump cartridge 330, allowing for visualization of the helical channel 332 provided in pump cartridge 330 for the flexible tube 310. The flexible tube 310 can be secured at either end or both ends to connectors 345 and 355 to prevent migration of the flexible tube 310 along its axis. Channel 332 is designed to have a radial depth that causes full occlusion of flexible tube 310 for one full helical loop around pump cartridge 330 beginning and ending in region 316. In principle the depth of channel 332 in region 314 can be gradually varied to minimize inflow pulsation. Likewise, the depth of channel 332 in region 315 can be gradually varied to minimize outflow pulsations.

The advantages of the inverted helical roller pump are that a single roller may be employed. In addition, extending the length of regions 314 and 315 to minimize inflow and outflow pulsations can be realized by extending the path length of the helical groove or channel 332 for one additional revolution each around pump cartridge 330. In addition, because a single roller is utilized, the cartridge 330 may be easily inserted axially but laterally displaced such that no tube compression will occur during the axial insertion. Once fully inserted axially, the pump cartridge 330 may be moved lateral relative to the roller to effect the pinch-off of the tube, thus completing the cartridge loading operation. Such loading is a difficult problem for most conventional peristaltic pumps.

U.S. Pat. 5,630,711 teaches use of a full loop of flexible tubing around a modified helical path within a stationary outer shell to allow for the inlet and outlet of the flexible tubing to be on axis apart from a small lateral displacement. In this patent, two internal rollers are used to compress the tubing, as less than 360 degrees of the helical tubing path allow for occlusion between the rollers and the outer shell. This configuration does not allow for use of a single roller.

U.S. Pat. 5,429,486 describes a peristaltic pump utilizing a single internal roller and tubing contained within the outer shell that is passed through the pump in a helical geometry. This configuration is similar to the current invention but the rollers and shell are not inverted, but rather the inner roller and outer stationary shell are similar to non-inverted conventional peristaltic roller pumps. Canadian Patent 320,994 also describes placing a full loop of helical tube within a stationary outer shell and using a single internal a concentric roller to pump fluid along the tube.

U.S. Pat. 5,688,112 describes placing tubing along a helical path within an outer stationary shell and using multiple internal rollers to pump fluid through the tubing. This patent orients the tubes such that the tubes discharge along the axis of the rollers as opposed to tangentially exiting the pump.

III. Orbital, Single Concave Roller Pump

Figure 10:
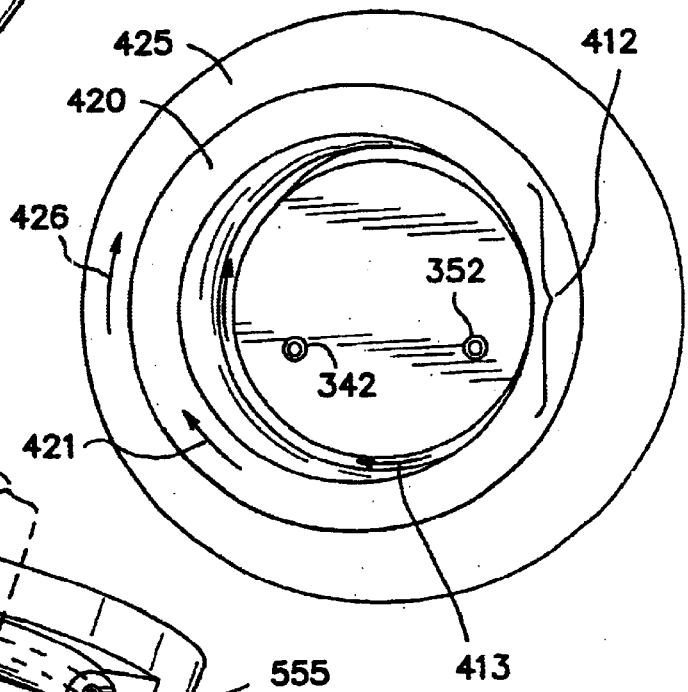
FIG. 10 is a schematic showing of another embodiment of an inverted peristaltic pump of the present invention wherein the compression member(s) comprise a single cylindrical compression member.

In some embodiments of single-roller pumps of the present invention, as described above, the surface of the roller that contacts the tube may be concave so as to make the pinching-off of the tube more gentle. This is illustrated in FIG. 10 wherein a single concave roller 420 comprises a thin walled cylinder and the surface of that roller 420 that pinches-off the tube is a single concave surface, as shown. Similar to a conventional single roller design an ex-centric drive 425 can be used and the thin wall cylinder should be free to rotate about the ex-centric axis, which is the center of the cylinder.

For this configuration (similar to the inverted helical single roller pump configuration above) a special loading mechanism is conceived: In operation the single concave roller 420 is ex-centric and pinches-off the tube (configured around the pump cartridge 330) on one side 412. However, if during loading the pump cartridge 330 relative to the single concave roller can be made more concentric, then it is possible to have no contact with the tube 310 and therefore no friction during loading. Once inserted axially, the pump cartridge 330 may be moved lateral relative to the inner orbiting sleeve 420 by a the loading mechanism, thus completing the cartridge loading operation by bringing it into final position and pinching-off the tube 310.

Figure 11:
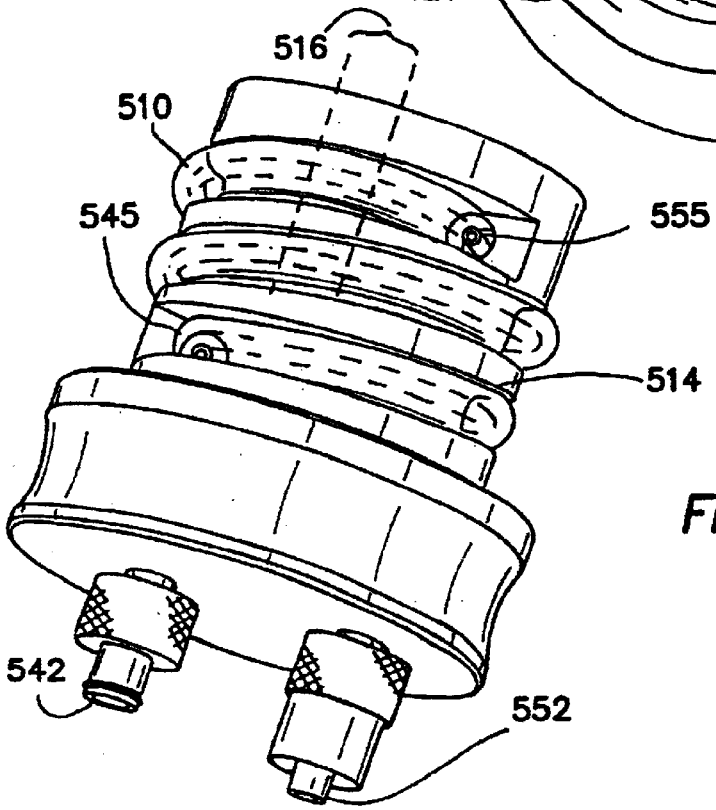
FIG. 11 is a showing of the central core/tubing cartridge component of the pump shown in FIG. 10.
Figure 12:
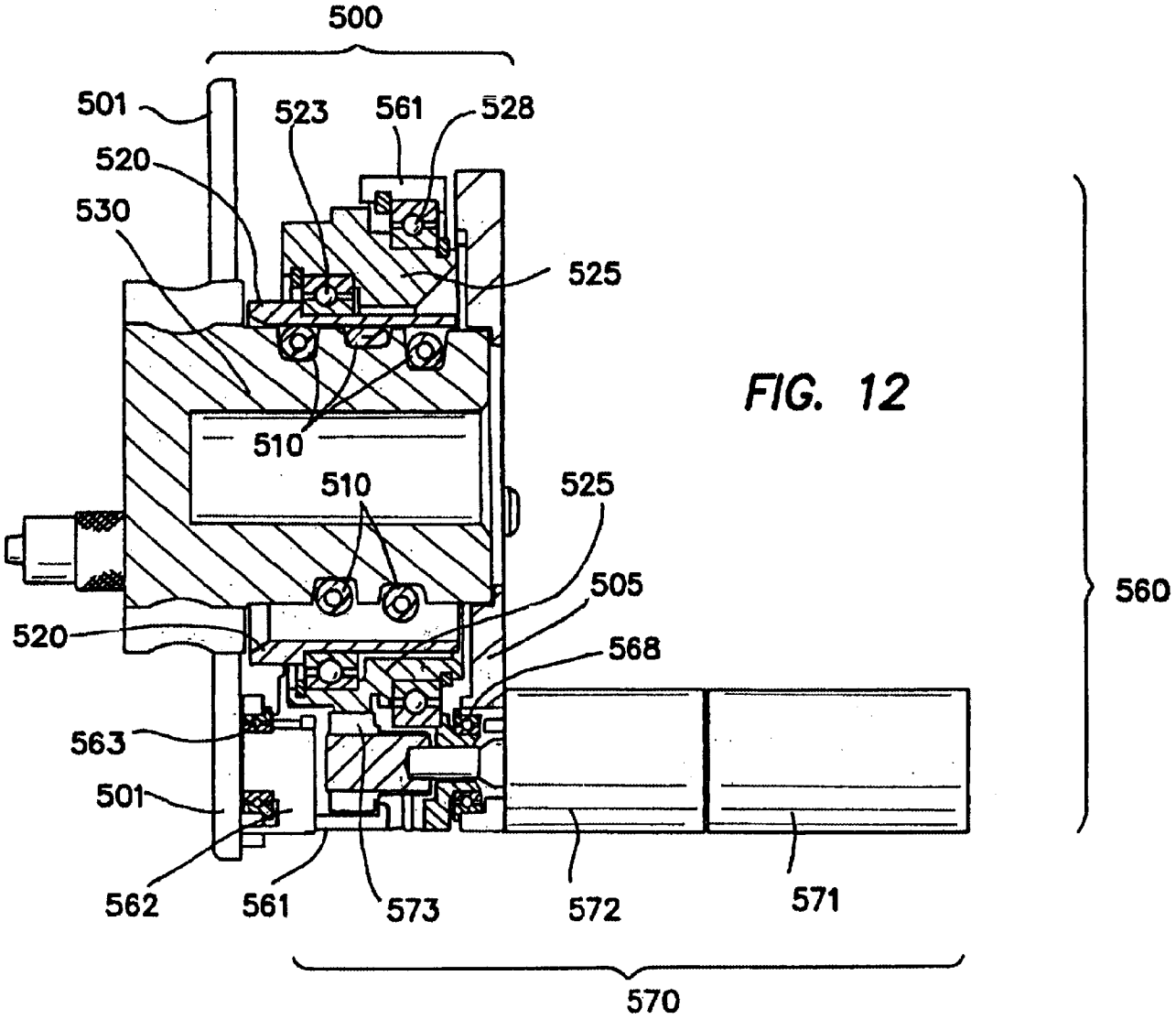
FIG. 12 is a cross sectional view of a pump of the type shown in FIGS. 10–11 with an associated pump drive assembly.

In this invention, the helical pump cartridge described in FIGS. 7–9 and 11 is mounted into an orbital, single concave roller pump drive as shown in FIGS. 10 and 12. In this configuration, an ex-centric drive 425 is rotated by a motor drive in direction 426. Rotationally mounted within and carried by ex-centric drive 425 is single concave roller 420. Flexible tube 310 is occluded by compression between single concave roller 420 and stationary pump cartridge 330 in occlusion region 412. Rotation of ex-centric drive 425 in direction 426 causes occlusion region 412 to move in direction 413 and for single concave roller 420 to rotate within ex-centric drive 425 in direction 421 due to friction in contact with the convex side of the tube.

It may be observed that the occlusion region 412 is much extended along the axis of flexible tube 310 relative to the occlusion region 312 obtained for the single roller inverted helical pump of FIG. 6.

IV. A Preferred Embodiment of the Orbital, Single Concave Roller Pump

Presented in FIG. 11 is a preferred embodiment of a helical cartridge for use in an orbital, single concave roller pump. In this design, the female luer fitting 542 and male Luer fitting 552 are used for the fluid ports. The helical channel is designed so that one full revolution of flexible tube 510 can be fully compressed beginning and ending at region 516. The helical channel for the loop beginning and ending at region 514, beginning at the inlet connector 545 and extending to region 516 (full compression) gradually reduces in depth and the bottom of the channel changes from a full radius to a flat bottom with much reduced corner radii to accommodate flattening of the flexible tube 510 as it is increasingly compressed. This channel design makes compression of the tube very gradual from fully uncompressed to fully compressed and occluded. Defining a pump period from full pinch-off to next full pinch-off in this case equivalent to 360 degrees it is appreciated that gradual compression by means of a ramp over one period can be optimized to eliminate the fundamental harmonic of the pulsation. In this way, pulsation is greatly reduced. If the ramp is implemented on the inlet side pulsation of the suction is reduced, if the ramp were to be implemented on the outlet side pulsation of the discharge would be reduced, if a ramp on each side were to be implemented both pulsation of the suction as well as the discharge would be reduced independently. In the configuration shown in FIG. 11 the ramp is implemented on the side of fitting 542 witch will exhibit the reduced pulsation. Depending on the direction of rotation of the orbital compression around the pump cartridge, either only the intake pulsation for clockwise rotation or only the discharge pulsation for counter clock wise rotation would be minimized by the design of the channel for the tubing loop beginning and ending at region 514. Again, an additional variation would comprise of a cartridge lacking ports and connectors and having an extended channel such that an independent tube carrying ports could be snapped and strung into it for subsequent insertion into the pump assembly.

A preferred embodiment of the pump drive is presented in a cross section view in FIG. 12. Referring to FIG. 11 a cross section cut is made between the simultaneous full compression region 516 and outlet connector 555, consequently the pump cartridge 530 with the outlet port fitting 552 is shown in the middle region of the FIG. 12. The flexible tube 510 is exhibited in 5 cross-sections, of which the middle upper one is pinched-off, to the left the beginning of ramp 514 with minimal compression is shown, and to the right of it the ramp to the port 555 (not shown) shows no compression. The concave roller 520 is positioned maximal to the lower side of the figure by means of the ex-centric drive 525. Bearings 523 and 528 provide for free rotation of the components. The drive mechanism 570 includes an electric motor 571, a gearbox 572, and a low teeth number spur gear 573. The ex-centric drive 525 carries on its outer perimeter a high teeth number spur gear to engage with the drive mechanism 570. The gearbox 572 is mounted to the frame of the pump 500, specifically its rear plate 505, which also centers the pump cartridge 530 (shown partially hallow) in the rear. A swinging loading mechanism 560, specifically its swing 561 with its front extension 562 (both distinct from the frame of the pump 500), are provide to implement the no tube compression loading sequence described above, and its two bearings 563 and 568 are shown attached to the front 501 and rear plate 505 of the frame of the pump. The front plate 501 of the frame of the pump also provides centering for the front of the pump cartridge 530. The loading mechanism 560 works with a small rotation around bearings 563 and 568 in conjunction with an associated clocking of the ex-centric drive 525 (not shown).

It can be appreciated that the configuration shown in FIG. 12 has a generally flat or narrow profile (apart from the slender motor 571 and gearbox 572) and may be useable in limited space applications which require a shallow of the pump mechanism. However, configurations with the ex-centric drive configured axially further backwards can provide a less shallow configuration with a significantly smaller front area, as may be desirable in other applications. This may be accomplished by re-configuring the bearing arrangement 528 such that is outer race caries an elongated ex-center drive 525 and its inner race attaches to the re-configured swing 561. Both the ex-center drive 525 and the bearing arrangement 528 would than be located behind the pump cartridge 530.

Referring now to FIGS. 13–18, there are shown a number of examples of various different ways in which the components of a inverted pumps 601, 602, 604, 606, 608 and 610 of the present invention may be configured and constructed. In particular, these examples show different configurations of the core members 612, 620, 630, 640, 650 and 660 and different configurations of the rollers 614, 622, 632, 642, 652 and 662. These showings are not exhaustive of the multitude of different ways in which the core members and compression members (e.g., rollers) may be configured or constructed, but rather are merely examples of a few such configurations and constructions.

Figure 13:
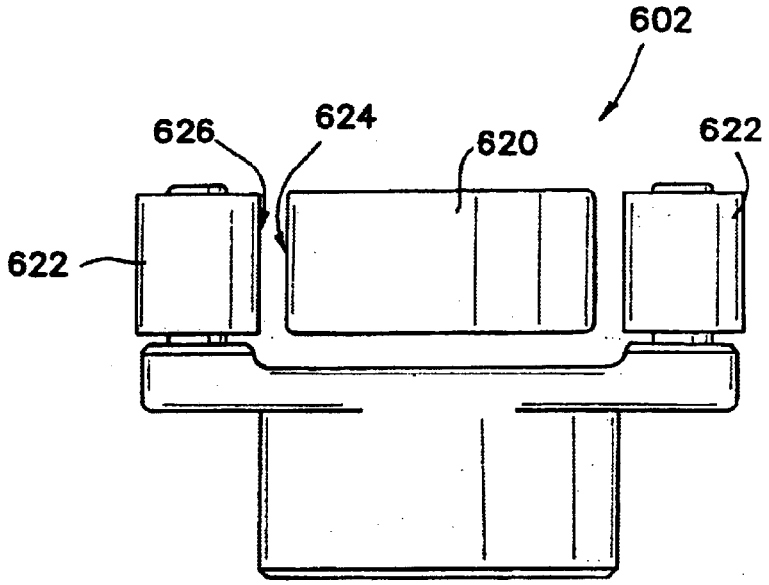
FIG. 13 is a schematic diagram of an inverted peristaltic pump of the present invention having a cylindrical core and straight cylindrical rollers.

The embodiment shown in FIG. 13 comprises an inverted peristaltic pump 608 of the present invention having a cylindrical core 620 with flat side walls 624 and cylindrical rollers 622 having flat side walls 626.

Figure 14:
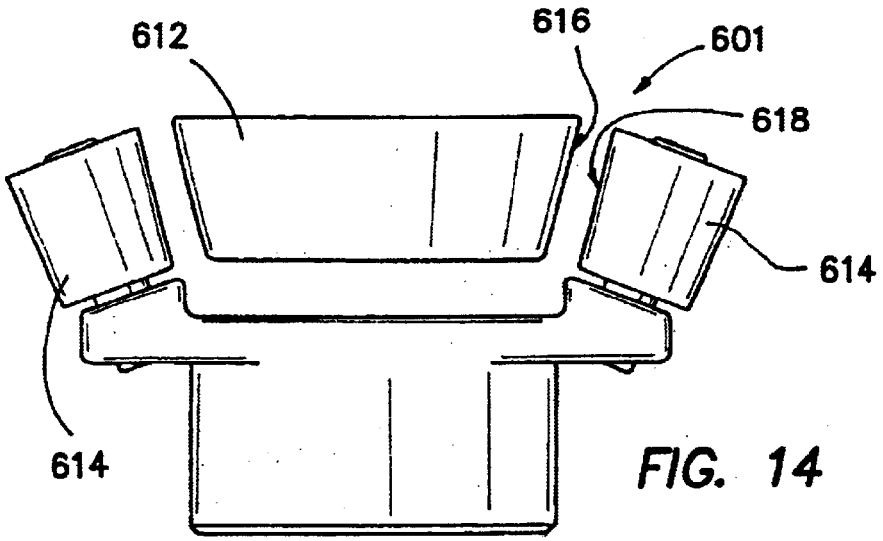
FIG. 14 is a schematic diagram of an inverted peristaltic pump of the present invention having a frusto-conical core and angled, frusto-conical rollers.

The embodiment shown in FIG. 14 comprises an inverted peristaltic pump 606 of the present invention having a frusto-conical core 612 the side walls 616 of which are flat and angled and frusto-conical rollers 614 which have flat, angled side walls 618, such rollers 614 being mounted on slants or angles as shown to cause their side walls 618 to be substantially parallel to the side wall 616 of the core member 612.

Figure 15:
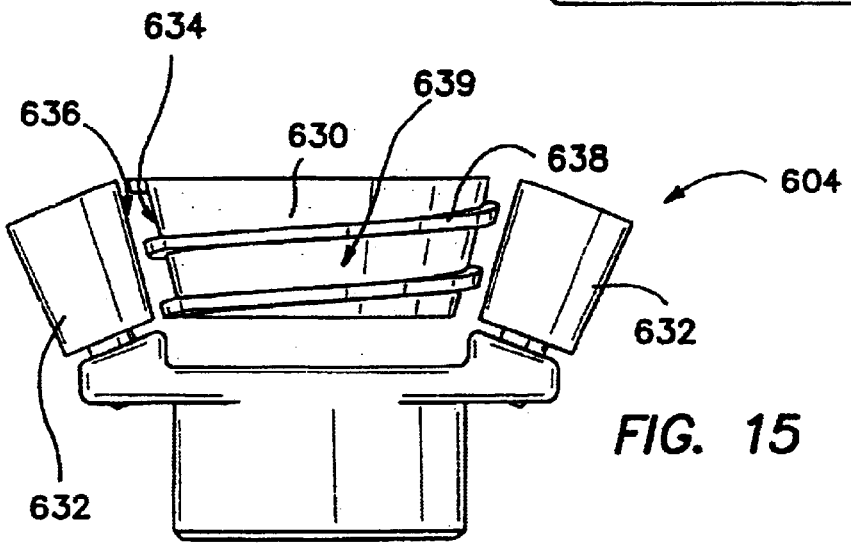
FIG. 15 is a schematic diagram of an inverted peristaltic pump of the present invention having a frusto-conical, grooved core and angled, frusto-conical rollers.

The embodiment shown in FIG. 15 is an inverted peristaltic pump 604 of the present invention having a frusto-conical, grooved core 630 and frusto-conical rollers 632 which have flat, angled side walls 618. A helical projection or ridge 638 is formed about the side wall 634 of the core 630 so as to define a helical channel or groove 639 in which the pump tubing (not shown) is disposed. The rollers 614 of this embodiment are mounted on slants or at angles, as shown, such that their side walls 618 are substantially parallel to the side wall 616 of the core member 612.

Figure 16:
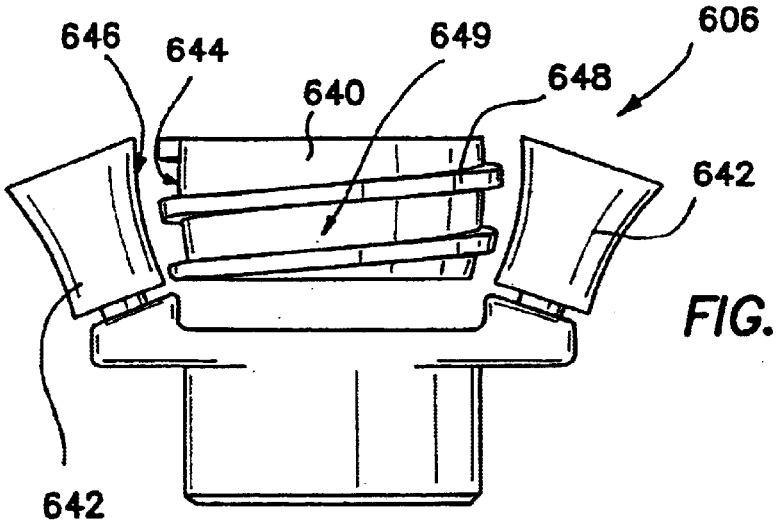
FIG. 16 is a schematic diagram of an inverted peristaltic pump of the present invention having a convex-walled, grooved core sized to accommodate one full revolution of tubing and angled, concave walled rollers.

The embodiment shown in FIG. 16 comprises an inverted peristaltic pump 606 of the present invention having a grooved core 640 with a convex side wall 644 and rollers 642 which have convex side walls 646 and are mounted on slants or angles such that the concave roller sire walls 646 are substantially parallel to the convex core side wall 644. A helical projection or ridge 648 is formed about the core side wall 644 so as to define a helical grove 649 within which one full revolution of pump tubing (not shown) may be disposed.

Figure 17:
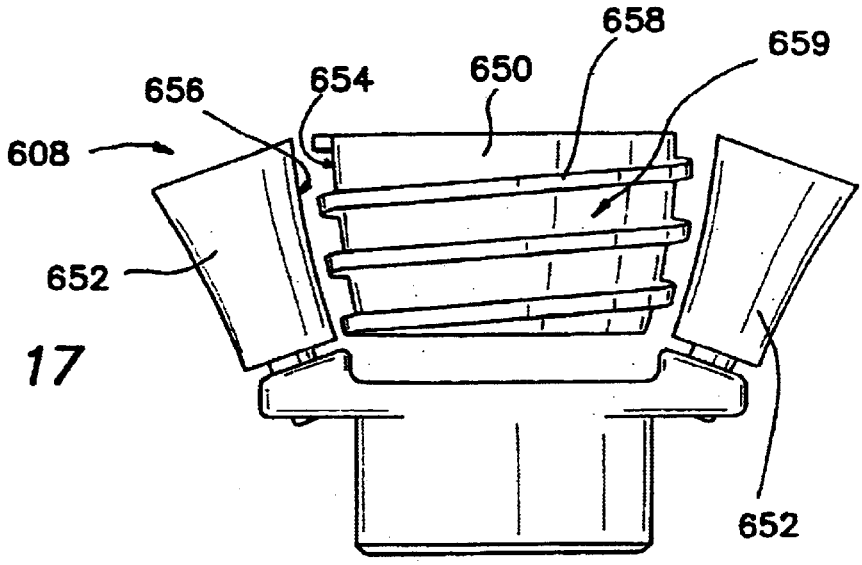
FIG. 17 is a schematic diagram of an inverted peristaltic pump of the present invention having a convex-walled, grooved core sized to accommodate two full revolutions of tubing and angled, concave walled rollers.

The embodiment shown in FIG. 17 comprises an inverted peristaltic pump 17 of the present invention having a grooved core 650 with a convex side wall 654 and rollers 652 which have convex side walls 656 and are mounted on slants or angles such that the concave roller sire walls 656 are substantially parallel to the convex core side wall 654. A helical projection or ridge 658 is formed about the core side wall 654 so as to define a helical grove 659 within which two full revolutions of pump tubing (not shown) may be disposed.

Figure 18:
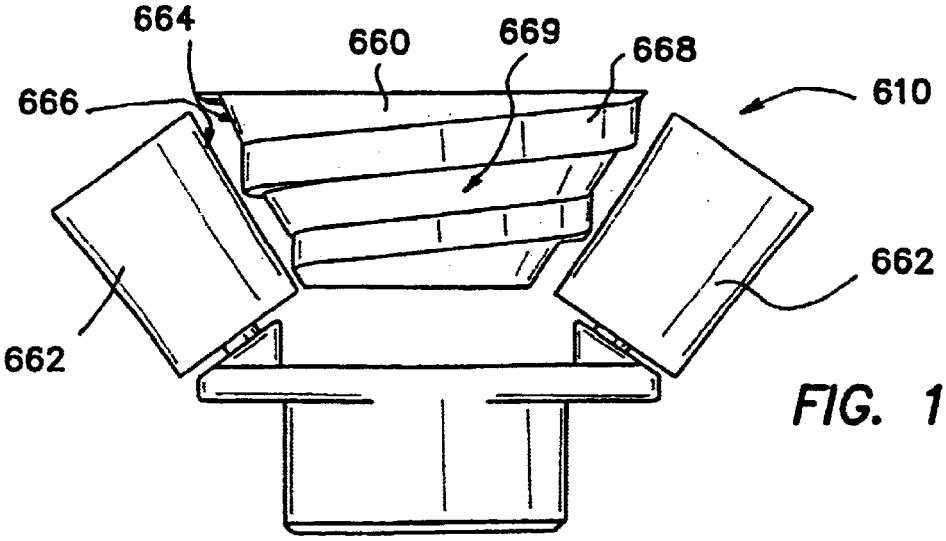
FIG. 18 is a shematic diagram of an inverted peristaltic pump of the present invention having a frusto-conical, grooved core and angled, frusto-conical rollers, the core being designed for easy demoldability from a two-piece mold.

The embodiment of FIG. 18 comprises an inverted peristaltic pump 610 of the present invention having a frusto-conical, grooved core 660 having a substantially flat side wall 654 and frusto-conical rollers 662 having substantially flat side walls 666. The rollers 662 are mounted on slants or angles such that their side walls 666 are substantially parallel to the side wall 664 of the core 650. A helical projection or ridge 668 is formed about the core side wall 664 so as to define a helical grove 669 within which the pump tubing (not shown) may be disposed. The helical projection 668 is configured such that the core 650 is devoid of undercuts or other design features that would complicate or deter demolding of the core from a typical two-piece plastic mold, such as may be used with an injection molding machine.

Although exemplary embodiments of the invention have been shown and described, many changes, modifications and substitutions may be made by those having ordinary skill in the art without necessarily departing from the spirit and scope of this invention. For example, elements, components or attributes of one embodiment or example may be combined with or may replace elements, components or attributes of another embodiment or example to whatever extent is possible without causing the embodiment or example so modified to become unuseable for its intended purpose. Accordingly, it is intended that all such additions, deletions, modifications and variations be included within the scope of the following claims.

What is claimed is:

1. A peristaltic pump device comprising:

an inner core member having an outer surface;

a generally tubular fluid conduit having a lumen that extends longitudinally therethrough, said fluid conduit being positioned on and extending at least partially around the outer surface of the core member;

an outer compression member positioned radially outside of the inner core member, said outer compression member being movable at least partially around the outer surface of the core member causing peristaltic compression of the fluid conduit so as to propel fluid through the lumen of the fluid conduit.

2. A peristaltic pump device according to claim 1 wherein a groove is formed in the outer surface of the core member and at least a portion of the fluid conduit is positioned within said groove.

3. A peristaltic pump according to claim 1 wherein the movement the compression member results in a substantially constant degree of compression of the generally tubular fluid conduit.

4. A peristaltic pump according to claim 1 wherein the movement the compression member results in varied degrees of compression of the generally tubular fluid conduit.

5. A peristaltic pump device according to claim 2 wherein the depth of the groove varies.

6. A peristaltic pump device according to claim 2 or 5 wherein the groove is a helical groove.

7. A peristaltic pump device according to claim 6 wherein the depth of the groove is greatest at its ends and least at its center.

8. A peristaltic pump device according to claim 1 wherein the fluid conduit makes more than one full revolution about the outer surface of the core member.

9. A peristaltic pump device according to claim 1 wherein the generally tubular fluid conduit comprises a tube.

10. A peristaltic pump device according to claim 1 wherein the generally tubular fluid conduit is formed separately from and disposed upon the core member.

11. A peristaltic pump device according to claim 1 wherein the generally tubular fluid conduit comprises a compressible conduit that is substantially fused to or formed integrally with the core member such that the fluid conduit may be peristaltically compressed against the core member by the compression member.

12. A peristaltic pump device according to claim 1 wherein the outer compression member comprises at least one roller.

13. A peristaltic pump device according to claim 1 comprising:

an inner core member having a groove formed in its outer surface;

a generally tubular fluid conduit comprising compressible tubing mounted on the inner core member, within said groove;

said inner core member having said tubing mounted thereon being insertable into a structure which incorporates said compression member such that subsequent actuation of the pump will cause the compression member to move about the core member, thereby causing peristaltic compression of the tubing against the core member.

14. A peristaltic pump according to claim 1 wherein the compression member rotates about an axis and wherein the core member is insertable into an operative position relative to the compression member advancing the core member in a direction that is substantially perpendicular to the axis.

15. A method of pumping fluid using a pump according to claim 1, said method comprising the steps of:

(A) providing a source of fluid to one end of the fluid conduit; and, (B) moving the outer compression member at least partially around the convex outer surface of the core member so as to cause peristaltic compression of the fluid conduit, thereby propelling fluid from the source of fluid, through the lumen of the fluid conduit.

16. A method of changing the fluid conduit of a pump according to claim 1, said method comprising the steps of:

(A) removing the inner core member having a first fluid conduit positioned thereon from the pump; and, (B) inserting a fluid core member having a second fluid conduit positioned thereon into the pump such that when the outer compression member is subsequently moved at least partially around the convex outer surface of the core member it will cause peristaltic compression of the second fluid conduit, thereby propelling fluid through the lumen of the fluid conduit.

17. A method according to claim 13 wherein the core member removed in Step A is reused and wherein the method further comprises:

removing the first fluid conduit form the core member after it has been removed from the pump in Step A; and, positioning the second fluid conduit on the core member before it is reinserted into the pump in Step B.

* * * * *